US009080430B2

(12) United States Patent
Al Busaidy

(10) Patent No.: US 9,080,430 B2
(45) Date of Patent: Jul. 14, 2015

(54) DEVICE FOR THE DYNAMIC UNDER BALANCE AND DYNAMIC OVER BALANCE PERFORATING IN A BOREHOLE

(75) Inventor: Adil Mahallab Al Busaidy, Seeb (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 382 days.

(21) Appl. No.: 12/792,981

(22) Filed: Jun. 3, 2010

(65) Prior Publication Data

US 2011/0011587 A1 Jan. 20, 2011

Related U.S. Application Data

(60) Provisional application No. 61/183,805, filed on Jun. 3, 2009.

(51) Int. Cl.

| | |
|---|---|
| ***E21B 43/119*** | (2006.01) |
| ***E21B 43/116*** | (2006.01) |
| ***E21B 43/114*** | (2006.01) |
| ***E21B 43/117*** | (2006.01) |

(52) U.S. Cl.
CPC ..... *E21B 43/114* (2013.01); *E21B 43/117* (2013.01)

(58) Field of Classification Search
USPC ..... 166/297, 55.1
See application file for complete search history.

(56) References Cited

U.S. PATENT DOCUMENTS

| | | | | |
|---|---|---|---|---|
| 2,976,940 | A * | 3/1961 | Surbatovich | 175/4 |
| 2,984,307 | A * | 5/1961 | Barnes | 175/4 |
| 3,029,732 | A * | 4/1962 | Greene | 102/310 |
| 4,467,878 | A * | 8/1984 | Ibsen | 175/4.6 |
| 4,683,943 | A * | 8/1987 | Hill et al. | 166/63 |
| 5,228,508 | A * | 7/1993 | Facteau et al. | 166/177.2 |
| 5,355,802 | A * | 10/1994 | Petitjean | 102/313 |
| 6,598,682 | B2 | 7/2003 | Johnson et al. | |
| 7,172,023 | B2 * | 2/2007 | Barker et al. | 166/297 |
| 7,284,612 | B2 * | 10/2007 | Ratanasirigulchai et al. | 166/297 |
| 7,409,992 | B2 * | 8/2008 | Zazovsky et al. | 166/297 |
| 7,913,758 | B2 * | 3/2011 | Wheller et al. | 166/259 |
| 8,327,746 | B2 * | 12/2012 | Behrmann et al. | 89/1.15 |
| 8,904,935 | B1 * | 12/2014 | Brown et al. | 102/310 |
| 2004/0089449 | A1 * | 5/2004 | Walton et al. | 166/297 |
| 2004/0231840 | A1 | 11/2004 | Ratanasirigulchai et al. | |
| 2005/0061506 | A1 * | 3/2005 | Grove et al. | 166/297 |
| 2007/0034369 | A1 * | 2/2007 | Ratanasirigulchai et al. | 166/63 |
| 2007/0158109 | A1 * | 7/2007 | Zazovsky et al. | 175/4.6 |
| 2008/0105430 | A1 * | 5/2008 | Cuthill | 166/297 |
| 2009/0084552 | A1 * | 4/2009 | Behrmann et al. | 166/298 |
| 2013/0032347 | A1 * | 2/2013 | Parker et al. | 166/285 |

OTHER PUBLICATIONS

Dictionary definition of "vent", accessed Oct. 24, 2013 via thefreedictionary.com.*

International Search Report dated Jul. 21, 2010 (International Application No. PCT/US2010/037188).

* cited by examiner

*Primary Examiner* — Blake Michener

(74) *Attorney, Agent, or Firm* — Jeffery R. Peterson; Brandon S. Clark

(57) ABSTRACT

According to a preferred embodiment, a dynamic underbalance device has a longitudinally extending tool string including an underbalance part. A first overbalance part is above the underbalance part and a second overbalance part below the underbalance part. Upon application of underbalance from the underbalance part and overbalance from the overbalance part, the overbalance and underbalance interact to isolate the underbalance.

10 Claims, 2 Drawing Sheets

DEVICE FOR THE DYNAMIC UNDER BALANCE AND DYNAMIC OVER BALANCE PERFORATING IN A BOREHOLE

PRIORITY

The present application claims priority to U.S. Provisional Application No. 61/183,805 filed on Jun. 3, 2009, the entire contents of that application being incorporated herein by reference.

TECHNICAL FIELD

The present application relates to perforating and/or fracturing in oilfield applications, and more specifically to focus of underbalance/overbalance through use of a transient underbalance/overbalance pressure plug when perforating a hydrocarbon well.

BACKGROUND

When a hydrocarbon well is drilled, a metal casing is placed in the well to line the wellbore. Additionally, space between the liner and the formation is often filled with cement. In order to connect the inside of the casing and wellbore with the inside of the formation, to allow for hydrocarbon flow from the formation to the inside of the casing, holes are formed through the casing and into the wellbore. This practice is commonly referred to as perforating of the casing and formation. Open-hole wells are also possible, i.e., where a casing is not used and perforation is directly applied to the formation.

Perforating guns are used to perforate a casing and wellbore. A perforating gun is often a long tubular device housing a number of shaped charges that face generally in a radial direction outward toward the casing and the formation. A loading tube commonly supports the shaped charges and is loading into an outer tubular shaped housing. The loading tube can take many shaped, i.e, a tube with openings for placement of the shaped charges, a flat plate that supports the shaped charges, etc.

The shaped charges generally have a cup shaped body and a conical shaped liner located in the opening of the cup. Explosive material is located between the inside of the cup shaped body and the liner so that upon detonation the liner is projected outward from the shaped charge, thereby penetrating the casing, cement and formation.

There are issues connected with this general operation of perforating, e.g., debris becoming located within the perforations in the formation as well as damage to the formation that affects permeability. These ideas are explained in more detail herein. Thus, it is desired to create a situation where debris in the formation perforations is limited and permeability of the perforated formation is improved. One way to address those issues is with underbalanced perforation, i.e., creating a low pressure inside the perforating gun thereby drawing in well fluids during the operation of perforating to suck debris into the gun/wellbore and away from the formation, thereby limiting the amount of debris in the formation perforations.

The embodiments in this application address a number of those issues connected therewith and improve on various aspects of underbalanced perforating.

SUMMARY

According to a preferred embodiment, a dynamic underbalance device has a longitudinally extending tool string including an underbalance part. A first overbalance part is above the underbalance part and a second overbalance part below the underbalance part. Upon application of underbalance from the underbalance part and overbalance from the overbalance part, the overbalance and underbalance interact to isolate the underbalance.

BRIEF DESCRIPTION OF THE FIGURES

The following brief description of the drawing is meant to assist in the understanding of the described embodiments and is not in any way meant to unduly limit any present or future claim scope related to this application.

DETAILED DESCRIPTION

Figure 1:
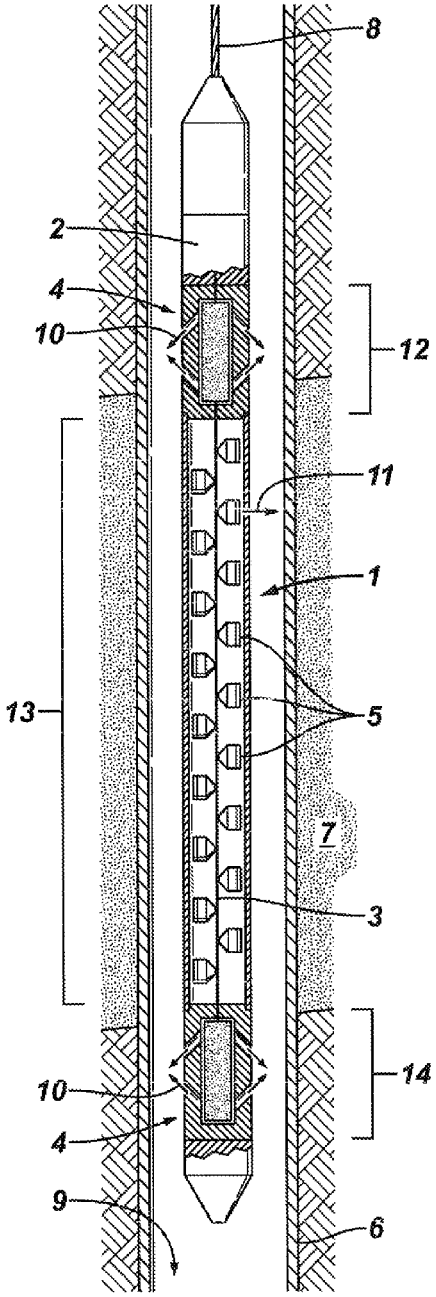
FIG. 1 shows a side view of an embodiment of various features.

The following description concerns a number of embodiments and is meant to provide an understanding of the embodiments. The description is not in any way meant to unduly limit the scope of any present or subsequent related claims.

As used herein, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

As noted above, the present application relates to perforating in connection with underbalance. U.S. Pat. No. 6,598,682, filed on Mar. 1, 2001, the entirely of which is incorporated herein by reference, relates to underbalanced perforating and provides helpful background to one skilled in the art.

Aspects of the present application relate to improving reservoir communication within a wellbore. To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in a casing and to extend perforations into the surrounding formation.

The explosive nature of the formation of perforation tunnels may shatter sand grains of the formation. A layer of "shock damaged region" having a permeability lower than that of the virgin formation matrix may be formed around perforation tunnels. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One method for obtaining clean perforations involves underbalanced perforating. The perforation is carried out with a lower wellbore pressure than the formation pressure.

The pressure equalization can be achieved by fluid flow from the formation and into the wellbore. This can be caused by flow into the perforating gun housing. This fluid flow carries some of the damaging rock particles away from the perforations and improves permeability. It should be noted that the underbalance operation can be carried out after perforation and without charges that perforate the casing or the formation.

The present application includes embodiments including dynamic underbalance in a defined interval of a well bore using a pressure wave to create a transient plug. These embodiments can improve fluid communication between the formation and the wellbore. The device can also be reconfigured to control dynamic overbalance in a defined area of wellbore with the same intention.

The present application includes embodiments that improve the performance of dynamic under balance and dynamic overbalance devices, such as PURE™ guns and PURE™ Chambers, available from Schlumberger™. Controlling transient pressure conditions in a wellbore is discussed in U.S. Pat. No. 7,284,612, which is incorporated herein by reference in its entirety.

The present application includes embodiments that create a transient pressure plug in the borehole above and below an implosion, dynamic under balance event or a dynamic overbalance event. For example, the transient plug could disrupt the movement and pressure effects of borehole fluids towards the area of dynamic under balance, implosion, or dynamic overbalance depending on the desired effect. Also, the transient plug could contain the effects of the implosion, dynamic under balance or dynamic overbalance effect to a defined region in the wellbore.

Now, looking at the figures, the device shown in FIGS. 1 and 2 has two vented combustion chambers positioned above and below a low pressure chamber, or strings of low pressure chambers. The low pressure chamber(s) can be ruptured by the detonation of explosive primer cord, rapidly exposing the adjacent borehole to a low pressure shock. The primer cord can activate shaped charges to rupture the low pressure chamber and perforating the casing and formation. Alternatively, the low pressure chamber(s) can be ruptured when shaped charges are fired, thereby rapidly exposing the adjacent borehole to a low pressure shock, while not penetrating the casing or formation. The same primer cord detonation also can initiate the burning of a flammable solid or propellant (such as P4). The high pressure shock developed by this burn enters the borehole via the vents in the combustion chambers. The high pressure and low pressure transient shock waves will cancel each other out at the point where the shock fronts meet, effectively creating a pressure plug in the wellbore above and below the low pressure chambers.

Specifically, FIG. 1 shows an underbalance device 1 according to the present application located within a subterranean hydrocarbon well defined by a wellbore 9 that is lined with a casing 6, within a formation 7. The underbalance device 1 is supported by a tension member 8. The tension member 8 can be wireline, slickline, coiled tubing, production tubing, or any other item that is capable of relaying and supporting the underbalance device 1 downhole. The underbalance device 1 can be a perforating gun including a shaped charge 5 portion. A signal is transmitted via the tension member 8, and/or a signal conductor used in connection with the tension member 8. For example, cable including tension and load bearing capability as well as signal transmission can be used. Also, coiled tubing with an additional signal transmission line can be used. Or, a load bearing cable and an additional signal transmission line can be used.

A firing head 2 connects with the tension member 8. The firing head 2 receives a signal, electrical or otherwise, transmitted from uphole of the perforating gun device 1 by a signal generating device. Upon reception of the signal, the firing head 2 activates a detonation cord 3 that extends though the underbalance device 1.

The underbalance device 1 can include a portion that contains shaped charges 5. The shaped charges 5 are connected with the detonation cord and positioned to face radially outward from a longitudinal axis of the perforating gun device 1. An example of this direction is illustrated by the arrow 11. The shaped charges 5 can be perforating shaped charges for penetrating the casing 6 and the formation 7, or charges for merely rapidly opening access from the wellbore 9 into the underbalanced device 1. A transient pressure generating part 4 is located above the shaped charge 5 portion 13 and another pressure generating part 4 is located below the shaped charge 5 portion 13. Upon detonation of the detonation cord 3, propellant within the pressure generating parts 4 is ignited, thereby expelling matter outward from the pressure generating part 4 and creating a high pressure shock in the wellbore 9 proximate to each of the pressure generating parts 4. This high pressure shock serves to isolate the transient underbalance that is created upon firing of the shaped charges 5, thereby improving the overall perforating performance using transient underbalance. Arrows 10 show the direction of the high pressure shock exiting from the pressure generating parts 4.

The section 12 shows the upper high pressure generation region. Section 13 is the transient underbalance perforation region, delineated by the location of the shaped charges 5. Section 14 is the lower high pressure generation region.

Figure 2:
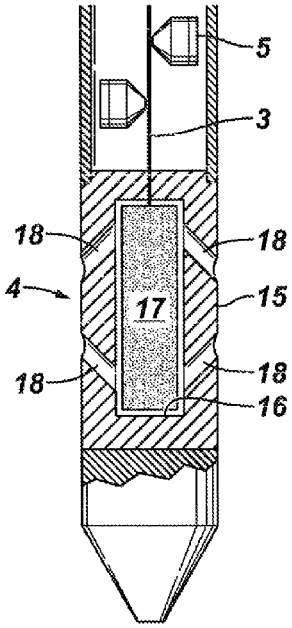
FIG. 2 shows a close-up side view of an embodiment of various features shown in FIG. 1.

FIG. 2 shows a more close up view of an embodiment of the high pressure generation part 4, shown as portion 15. The high pressure generation part 4 is connected with, for example, a lower portion of the perforating charge section. The high pressure generation part 4 has an internal cavity 16 that contains propellant 17. The propellant is connected with the detonation cord 3. Passages 18 are connected between the internal cavity 16 and the outside of the high pressure generation part 4, so that upon combustion of the propellant, high pressure matter is projected out the passages 18, thereby producing a high pressure shock in an area proximate to the high pressure generation part 4.

Figure 3:
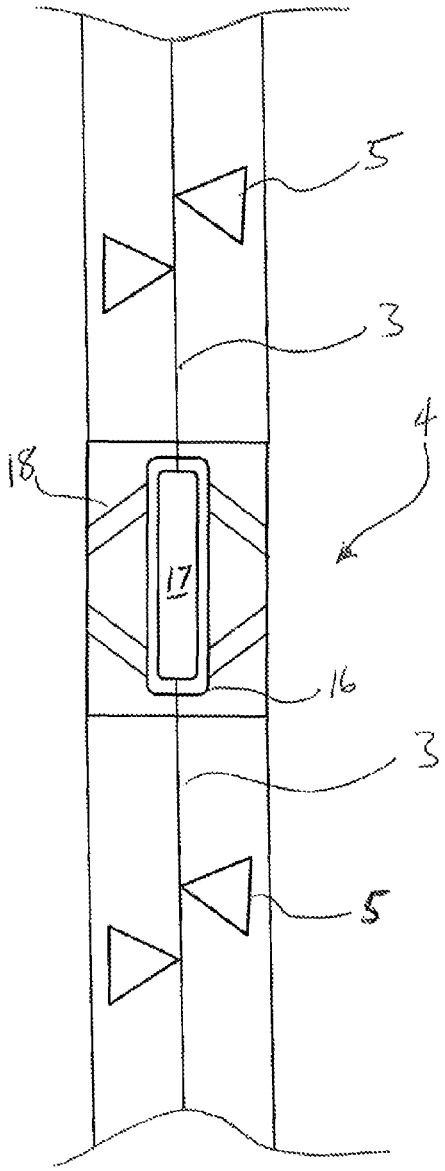
FIG. 3 shows a close-up side view of an alternative embodiment of various features.

A similar type of device can be used to control and focus the effects of dynamic over balance, as illustrated in FIG. 3. For example, FIG. 3 illustrates an overbalance device that may be implemented in a tool string. In that case the shaped charges 5 of the shaped charge sections would be placed above and below the high pressure generating parts 4, and all devices fired simultaneously with the intent of confining the effects of the dynamic over balance to a chosen region of the well bore.

The control and focus of dynamic underbalance and/or dynamic overbalance in a well bore can be beneficial, and can add specific applications to both dynamic underbalance and dynamic overbalance.

The preceding description herein is meant to provide an understanding of the present embodiments to one skilled in the art and is not meant in any way to unduly limit any present or subsequent related claims.

What is claimed is:

1. A dynamic underbalance device, comprising:

a longitudinally extending tool string including an underbalance part;

a first overbalance part above the underbalance part;

a second overbalance part below the underbalance part, the first and second overbalance parts each comprising a vented combustion chamber having a cavity with propellant located therein and passages leading from the cavity to outside the overbalance part, wherein the passages of each overbalance part are angled to converge toward a point within the borehole external to the overbalance part;

wherein upon application of underbalance from the underbalance part and overbalance from the overbalance parts, the overbalance and underbalance interact to isolate the underbalance.

2. The dynamic underbalance device of claim 1, wherein a plurality of shaped charges, the first overbalance part and the second overbalance part are connected with a detonation cord.

3. The dynamic underbalance device of claim 2, further comprising a firing head connected with the detonation cord.

4. The dynamic underbalance device of claim 1, the underbalance part comprising a perforating part, the perforating part containing shaped charges.

5. A dynamic overbalance device, comprising:

a longitudinally extending tool string including an overbalance part, the overbalance part comprising a vented combustion chamber having a cavity therein and propellant located within the cavity, and passages leading from the cavity to outside the overbalance part;

a first underbalance part above the overbalance part;

a second underbalance part below the overbalance part;

wherein upon application of overbalance from the overbalance part and underbalance from the underbalance parts, the overbalance and underbalance interact to isolate the overbalance, wherein the passages of the overbalance part are angled to converge toward a point within the borehole external to the overbalance part.

6. The dynamic overbalance device of claim 5, wherein the underbalance part comprises a plurality of shaped charges, wherein further the shaped charges and the overbalance part are connected to a detonation cord.

7. The dynamic overbalance device of claim 6, further comprising a firing head connected with the detonation cord.

8. The dynamic overbalance device of claim 5, the first and second underbalance devices each comprising a perforating part, the perforating part having shaped charges.

9. A method of dynamic underbalance perforating, comprising:

lowering a perforating gun downhole, the perforating gun comprising a section containing shaped charges, the shaped charge section having an internal volume that is opened to the outside of the perforating gun upon firing of the shaped charges, thereby allowing wellbore fluid to rush into the internal volume and create an underbalance condition in the wellbore;

locating a first overbalance part uphole and adjacent to the shaped charge section and locating a second overbalance part downhole and adjacent to the shaped charge section, wherein the first and second overbalance parts comprise vented combustion chambers having propellant;

connecting the first overbalance part, the second overbalance part, and the shaped charge part with a detonation cord;

detonating the detonation cord, thereby detonating the first overbalance part, the second overbalance part, and the shaped charge part to generate a pressure shock in the wellbore proximate to each of the overbalance parts, and to fire the shaped charges thereby creating an underbalance condition proximate to the shaped charge part; and directing the propellant outside the overbalance parts via passages, the propellant converging at a point within the borehole outside of the respective overbalance part, thereby forming a transient barrier.

10. The method of claim 9, comprising detonating propellant in the first overbalance part and the second overbalance part.

* * * * *